US007314327B2

(12) United States Patent
Byun

(10) Patent No.: US 7,314,327 B2
(45) Date of Patent: Jan. 1, 2008

(54) COSMETICS CASE

(76) Inventor: Young-Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 397 days.

(21) Appl. No.: 11/046,749

(22) Filed: Feb. 1, 2005

(65) Prior Publication Data

US 2006/0043123 A1 Mar. 2, 2006

(30) Foreign Application Priority Data

Aug. 24, 2004 (KR) ..... 10-2004-0066658

(51) Int. Cl.

| | |
|---|---|
| ***B43K 1/06*** | (2006.01) |
| ***B43K 5/06*** | (2006.01) |
| ***A47L 13/30*** | (2006.01) |
| ***A45D 40/04*** | (2006.01) |

(52) U.S. Cl. ..... 401/265; 401/263; 401/172; 401/69

(58) Field of Classification Search ..... 401/68, 401/69, 172, 173, 174, 175, 263, 277, 205; 222/390

See application file for complete search history.

(56) References Cited

U.S. PATENT DOCUMENTS

| | | | | |
|---|---|---|---|---|
| 2,546,195 A * | 3/1951 | Mellette | ..... | 401/69 |
| 4,071,300 A * | 1/1978 | Nichols et al. | ..... | 401/175 |
| 5,653,338 A * | 8/1997 | Tani | ..... | 206/385 |

* cited by examiner

*Primary Examiner*—David J. Walczak
(74) *Attorney, Agent, or Firm*—Birch, Stewart, Kolasch & Birch, LLP

(57) ABSTRACT

A cosmetics case for liquid cosmetics such as liquid foundation or liquid lipstick for making-up and possible to forcibly discharge the same, if used, and comprising a cylindrical main body to contain the cosmetics; and an upper movable body connected with a nozzle member and a discharging member on a top portion of the upper movable body, wherein the upper movable body is rotationally connected to a top portion of the main body, wherein both of upper and lower screw bars are combined with a piston mounted in the main body and the upper movable body, and wherein both screw bars move downward in order to press the cosmetics, in turn, to discharge the cosmetics through a nozzle and exhausting holes outside, thereby accomplishing the make-up.

5 Claims, 6 Drawing Sheets

COSMETICS CASE

This non-provisional application claims priority under 35 U.S.C. § 119(*a*) based on Patent Application No. 2004-0066658 filed in Korea on Aug. 24, 2004, the subject matter of which is herein incorporated by reference.

BACKGROUND OF THE INVENTION

1. Field of the Invention

The present invention relates to a dischargeable cosmetics case for liquid cosmetics such as liquid foundation or liquid lipstick for making-up and possible to forcibly discharge the same, if used, more particularly, including a cylindrical main body to contain the cosmetics and a piston connected to a screw bar to move downward and to apply pressure inside of the main body as the main body turns to any one direction, resulting in discharging of the liquid cosmetics contained in the main body outward.

2. Description of the Related Art

Generally, cosmetic products are classified into solid and/or powdery status, and liquid status. In recent years, liquid cosmetics in the form of lipstick or foundation for convenient use of consumers is developed, which is usually made of liquid cosmetics charged in a housing in the form of pencil and is discharging through an upper brush member of the housing when turning any part of the housing to right or left direction and forcibly pressing inner side of the housing. Various constructional forms of such pencil type cosmetics are proposed and practically used in applications concerned.

An embodiment of conventional cases discharging liquid cosmetics has typical construction, as illustrated in FIGS. 6 and 7 of the accompanying drawings herein.

The above case usually includes a main body 101 to contain liquid cosmetics, a cosmetic brush 102 for discharging the cosmetics possible to make up and a cap 103 for protecting the cosmetic brush 102.

Within the main body 101, installed are a rod 104 having a piston 103 to press out the liquid cosmetics toward the cosmetic brush 102 side; a movable body 105 consisting of a nut member 105*a* screw-connected to the rod 104 and, simultaneously, fixed on wall of the main body 101 to assist movement of the rod 104 (movement to upper side), and a single-directional rotation guiding member 105*b* rotating to only direction to the nut member 105*a*; and a rod-movement cap 106 for rotating the rod 104.

As described above, the conventional liquid cosmetics case has the piston 103 fitted into an engaging part 104*a* on front end of the rod 104, thus, causes severe shaking (or vibration) of the piston 103 out of the rod 104, in addition to, has a disadvantage of easy disconnection between the rod 104 and the piston 103 even by small impact. Another spring 107 is fitted into rear end of the rod 104. The spring is directly supported by the rod-movement cap 106 at one end of the spring 107 to apply repulsive force to the single-directional rotation guiding member 105*b*, so that the supported end interferes with the rod-movement cap 106 when the rod-movement cap 106 moves pivotally. Accordingly, the rod-movement cap 106 does not smoothly rotate and has a defect of generating noise.

Further, the conventional cosmetics case can turn to only the one direction due to the movable body 105 comprising the nut-member 105*a* and the single-directional rotation guiding member 105*b* but cannot rotate contrary to the above direction, that is, reverse-direction, whereby it necessarily causes leak of the liquid cosmetics if the case is under weak impact or pressure and/or positioned upside down.

Still further, the conventional case with the above construction has a complex structure to lead to increasing of production cost thereof.

SUMMARY OF THE INVENTION

It is, therefore, an object of the present invention is to solve the above problems, in particular, to provide a cosmetics case including a main body and a piston fixed to bottom portion of a pipe-type screw bar hollowed inside, and a reversing-resistant ball within a nozzle fitted in and connecting to top end of the screw bar, wherein the screw bar turns and presses the piston downward depending on rotation of the main body, in turn, applies pressure inside of the main body containing liquid cosmetics to render the cosmetics to pass through the screw bar and the nozzle, then be discharged outside. After completion of use, it is possible to prevent the cosmetics from being discharged by the reversing-resistant ball.

Therefore, the present inventive cosmetics case ensures discharging of the liquid cosmetics with a simple structure so that it can improve commercial value of goods and availability, eliminate noise and simplify construction of the case, thereby rendering production of the cosmetics case economically advantageous.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

Figure 1:
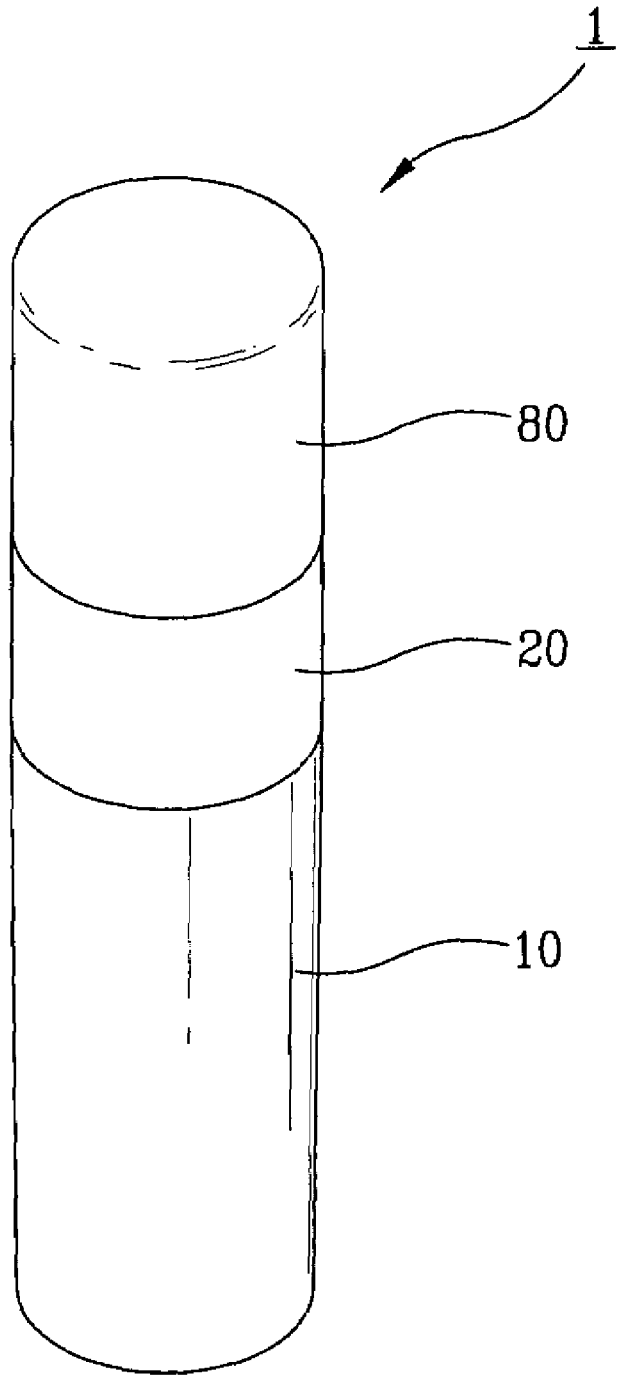
FIG. 1 is a perspective view illustrating entire appearance of a cosmetics case in an assembly condition according to the present invention.

The present invention will be described in more detail be reference to the accompanying drawings and following embodiments which are presented for purpose of illustration and should not be construed to limit the scope of the invention thereto.

FIGS. 1 to 5 shows a cosmetics case according to the present invention.

A cosmetics case 1 of the present invention includes generally a cylindrical main body 10 containing cosmetics 100 at bottom portion of the case 1; and an upper movable body 20 arranged with a nozzle member 40 and a discharging member 30 connected on a lop portion of the body 10, wherein both of upper and lower screw-bars 62 and 64 and a piston 66 are mounted inside the main body 10, and the upper movable body 20 is integrated together with the main body 10.

The body 10 is in a form of cup having open top and closed bottom parts and serves as a press cylinder and, at the same time, stores the liquid cosmetics 100 therein. A connection sill 12 is formed on outer top side of the body 10 in order to render the upper movable body 20 to be fixed at its position without separation and possible to carry out free-rotation.

Alternatively, the upper movable body 20 coupled to the body 10 has a connection groove 22 its inner lower side, which is joined to the connection sill 12 and a concave and convex part 24 (hereinafter referring to as "uneven part") in the form of screw thread, which is placed above the connection groove 22 and fitted into a screw-guidance ring 50 described below. The upper movable body 20 is integrated with the nozzle member 40 having a nozzle 42 extended downward from a top portion of the upper movable body 20.

On top surface of the nozzle member 40, formed is a distribution groove 44 in a concave form to evenly distribute the cosmetics 100 over wide area when discharging the cosmetics 100 through the nozzle 42.

A reversing-resistant ball 46 is entered in top portion of the nozzle 42 to prevent the cosmetics 100 from leaking when the cosmetics 100 is not used.

The discharging member 30 which is coupled on top portion of the nozzle member 40 has a number of exhausting holes 32 to discharge the cosmetics 100 already transferred in the distribution groove 44 through the nozzle 42 outside. A cap 80 is mounted on top portion of the discharging member 30 and coupled with the upper movable body 20.

In addition, the above respective upper and lower screw bars 62 and 64 have larger and smaller diameters and are screw-connected each other. A piston 66 is fixed to bottom end of the lower screw bar 64 and tightly fitted inside the body 10.

Figure 3:
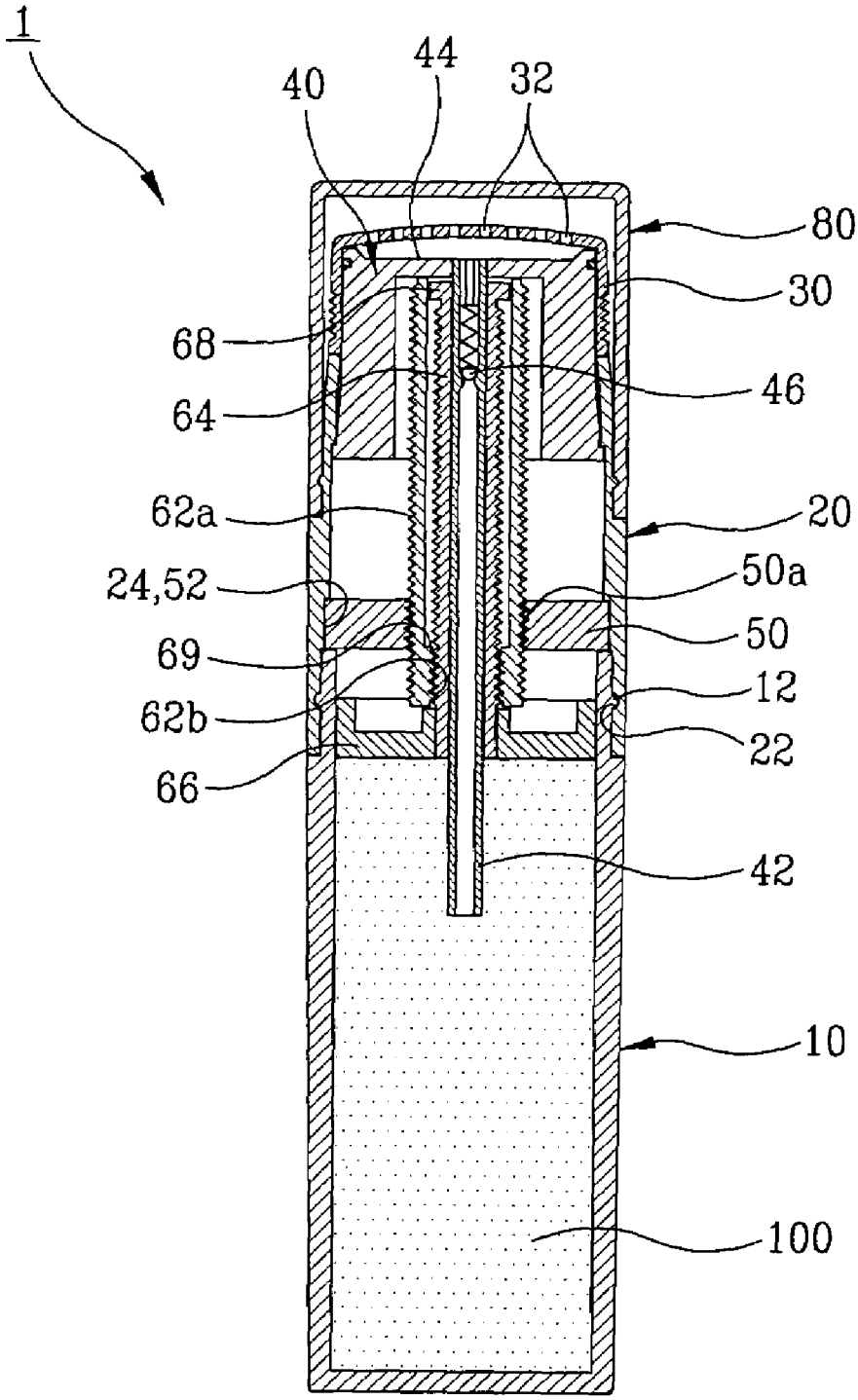
FIG. 3 is a sectional view illustrating the cosmetics case of the present invention in the assembly condition before using the cosmetics contained in the case.
Figure 4:
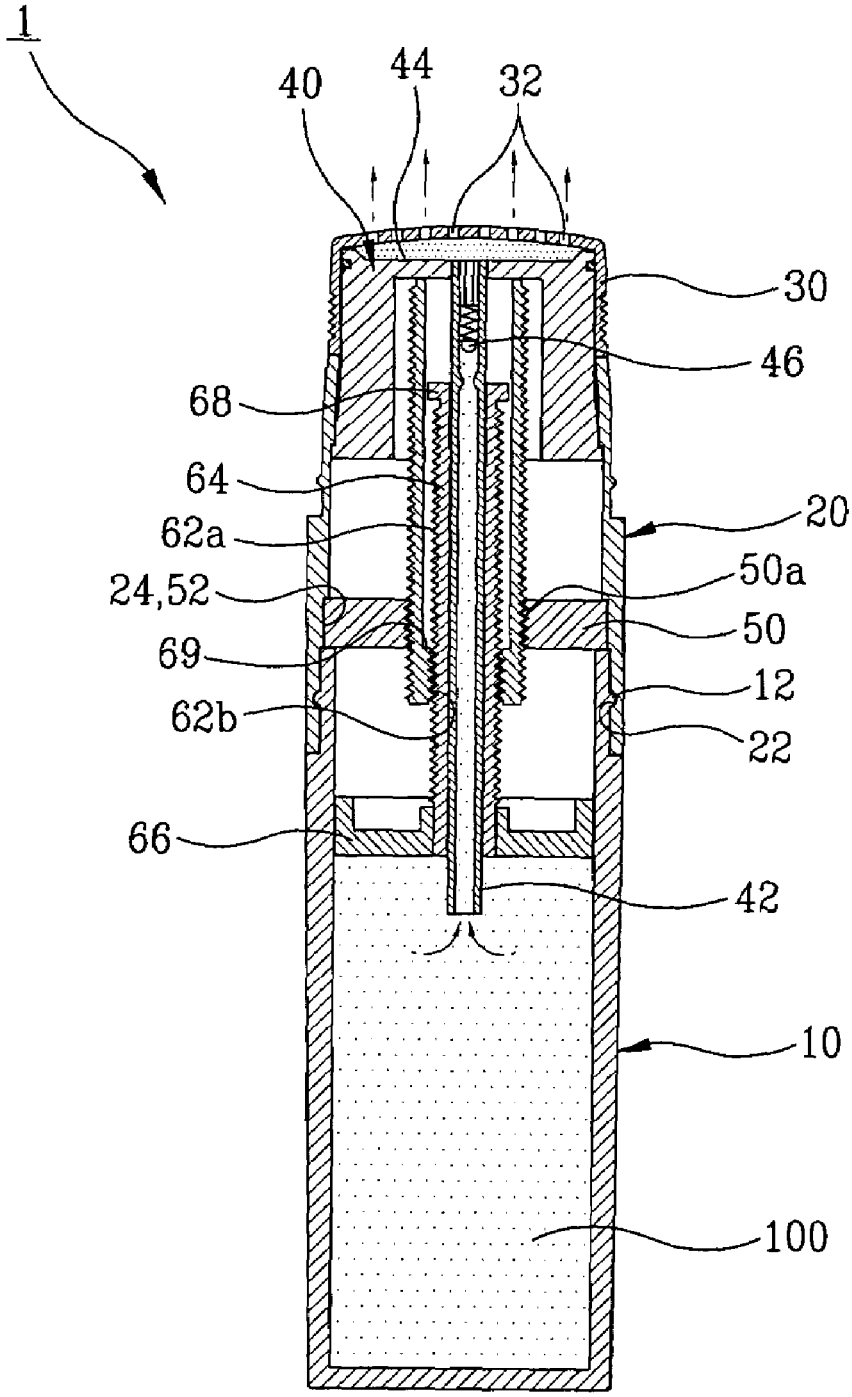
FIG. 4 is a view in detail illustrating the cosmetics case of the present invention at use condition in which a lower screw bar moves downward to discharge the cosmetics.
Figure 5:
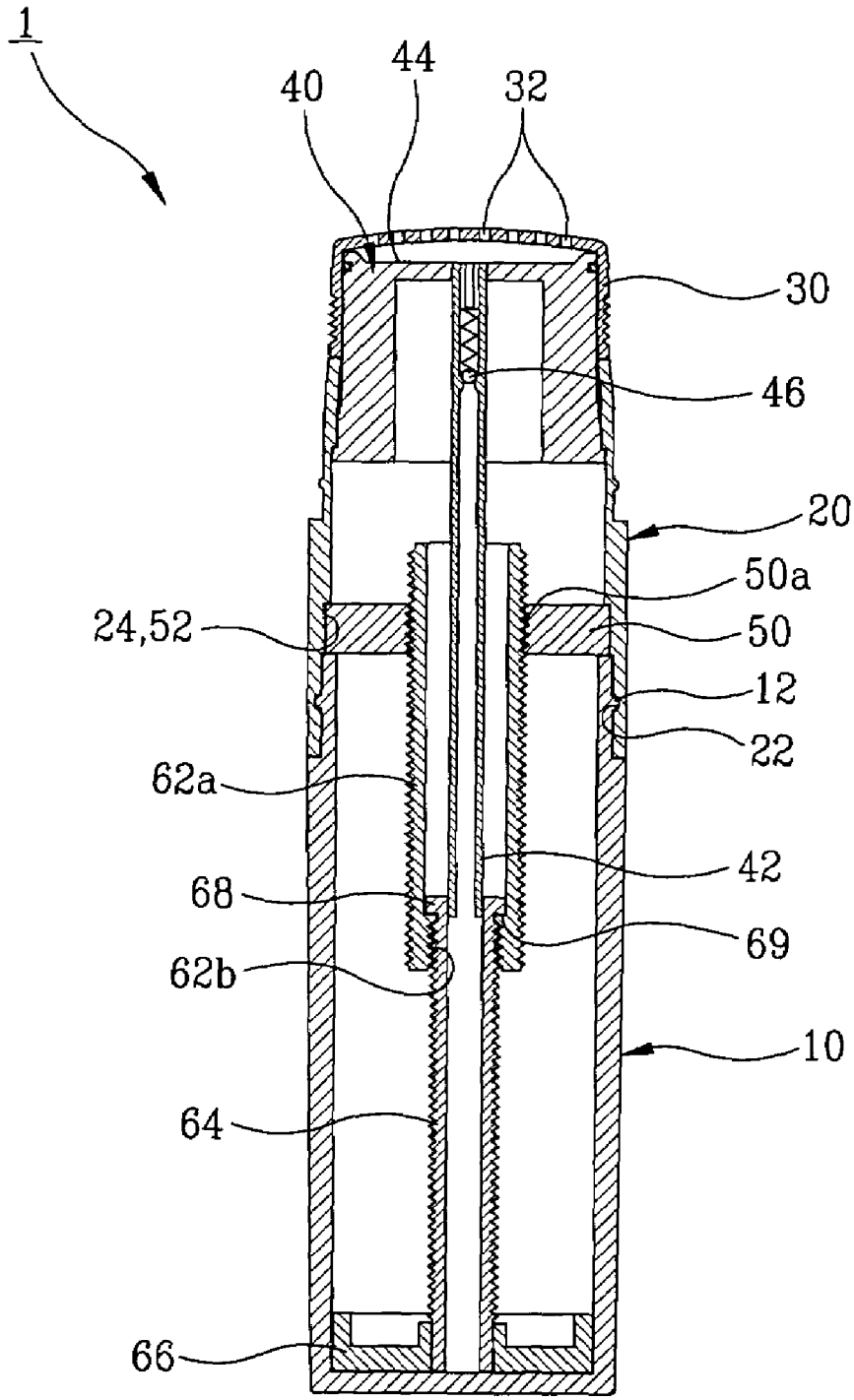
FIG. 5 is a view in detail illustrating the cosmetics case of the present invention at use condition in which both of the lower screw bar and an upper screw bar move downward to completely exhaust the cosmetics.
Figure 6:
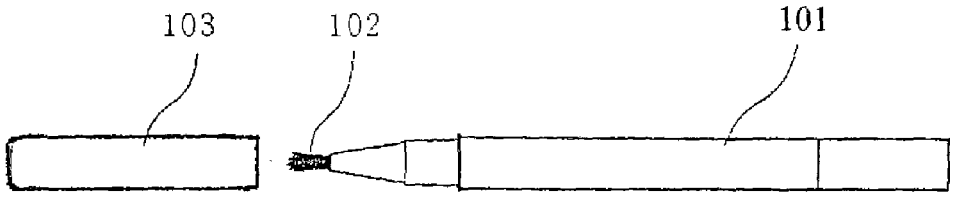
FIG. 6 RELATED ART
FIG. 6 is a front view illustrating a conventional discharging-type case for liquid cosmetics.
Figure 7:
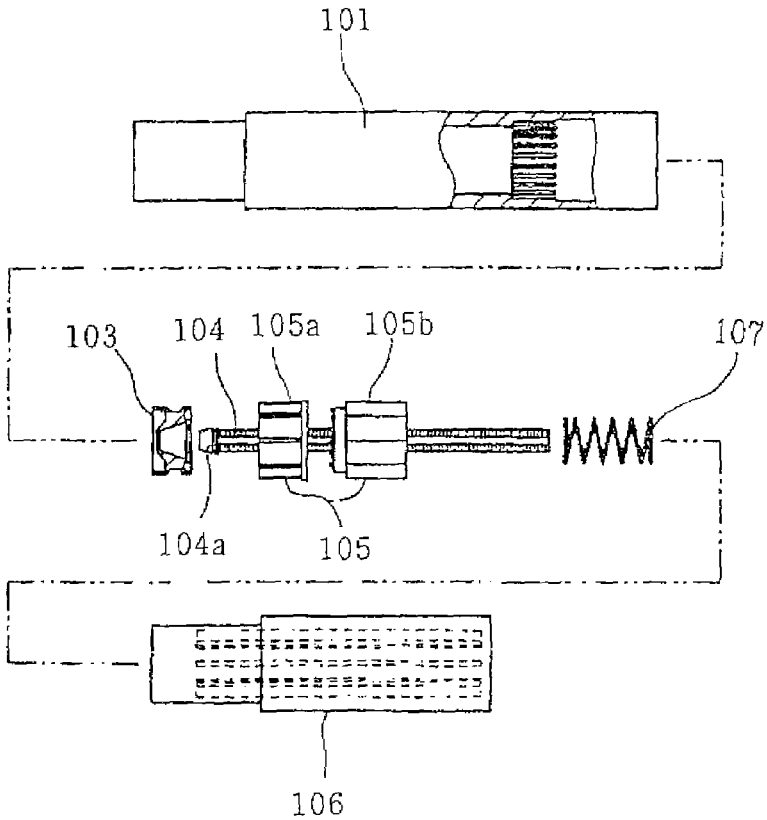
FIG. 7 RELATED ART
FIG. 7 is a exploded perspective view illustrating the conventional discharging-type case for liquid cosmetics.

The upper and the lower screw bars 62 and 64 are connected together in the same manner as shown in FIGS. 3 to 5. More particularly, the upper screw bar 62 having the screw thread 62*a* over entire part of outer surface thereof is fitted with the screw-guidance ring 50, while another screw thread 62*b* being partially formed on inner lower side of the upper screw bar 62 and screw-connected with the lower screw bar 64.

Accordingly, the upper screw bar 62 moves up and down along the screw-guidance ring 50 fitted into the uneven part 24 and fixed in its position, while the lower screw bar 64 can move up and down along the upper screw bar 62.

Figure 2:
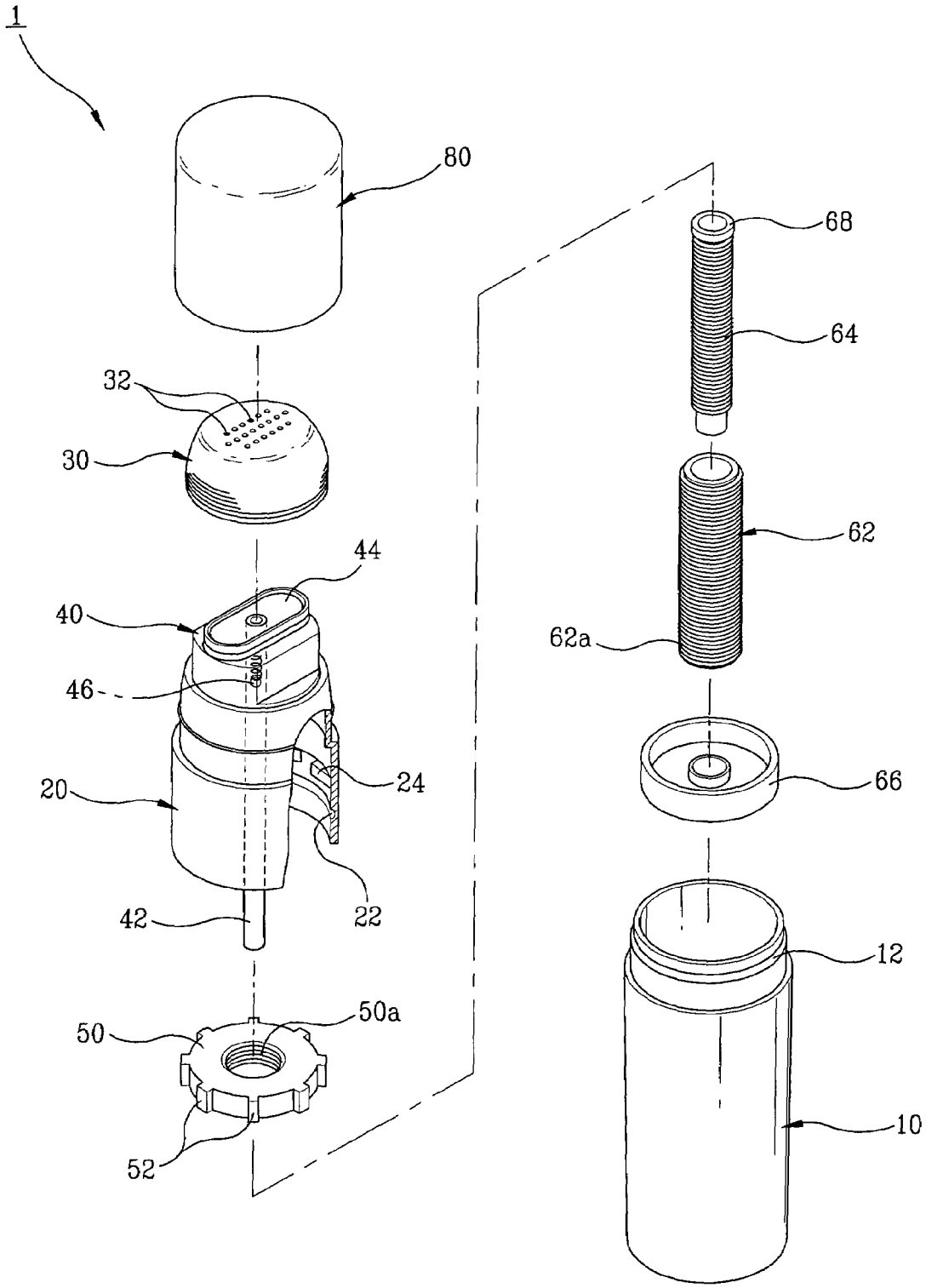
FIG. 2 is an exploded perspective view illustrating the cosmetics case of the present invention.

As shown in FIG. 2, the screw-guidance ring 50 has a threading line 50*a* inside to be fitted with the upper screw bar 62 and, simultaneously, projections 52 around peripheral side of the screw-guidance ring 50 to be inserted between concaves of the uneven part 24 formed inside the upper movable body 20 in order to inhibit rotation thereof.

The present inventive case constructed as described above is assembled as shown in FIG. 3.

In the main body 10, desirable amount of the cosmetics 100 is stored. The nozzle member 40 coupled with the discharging member 30 is connected to the upper movable body 20, and connection groove 22 of the upper movable body 20 is connected to the connection sill 12 of the main body 10 so that the main body 10 and the upper movable body 20 can be integrated together in a rotation-possible manner.

The lower screw bar 64 is fitted into the piston 66 not to move, then, into the upper screw bar 62. The screw-guidance ring 50 is screw-connected to outer side of the upper screw bar 62.

As the upper and the lower screw bars 62 and 64 are connected together, the screw-guidance ring 50 is connected with the uneven part 24 in the upper movable body 20. More particularly, the projections 52 around peripheral side of the screw-guidance ring 50 are inserted between the concaves of the uneven part 24 to inhibit rotation of the screw-guidance ring 50.

Functional effect of the present invention having such construction described above will be more understood with reference to practical use according to the following description.

Firstly opening the cap 80 then turning the main body 10 to one direction by one hand (for example, clockwise direction) while gripping the upper movable body 20 by the other hand when the cosmetics 100 is used for the make-up, the piston 66 rotates together with the main body 10 because it is tightly engaged to the main body side 10. Therefore, the lower screw bar 64 connected to the piston 66 is also under rotation and naturally moves downward to press the main body 10 containing the cosmetics 100 because it is screw-connected to the upper screw bar 62 (at this time, the upper screw bar is supported by the screw-guidance ring and is placed in its position without movement).

Accordingly, with desired pressing force of the piston 66, the cosmetics 100 is delivered into wide area of the distribution groove 44 through the nozzle 42 and simultaneously discharged through the exhaust holes 32, thereby being used for the make-up (see FIG. 4).

In this case, the reversing-resistant ball 46 is opened by applying pressure to allow the cosmetics 100 to be transferred. If the pressure is removed, the reversing-resistant ball 46 returns to its original position to help prevention of the cosmetics 100 from passing through.

Meanwhile, the present cosmetics case may further comprise any make-up aids (not shown) such as a sponge type member or a brush enveloping outer top portion of the discharging member 30, optionally for convenience of manufacturers, in case where the cosmetics 100 is discharged outside through the exhaust holes 32.

Using such a case mentioned above at the first time, the lower screw bar 64 fixed with the piston 66 moves downward to press the main body 10 when the main body is turned to any direction, thereby ensuring the make-up. In case the lower screw bar 64 continuously falls down, a projection sill 68 is engaging to another projection sill 69 on inner lower end of the upper screw bar 62 to block rotation thereof then prevent the downward movement of the lower screw bar 64, resulting in integration of the lower screw bar 64 with the upper screw bar 62.

Under the condition described above, if the main body 10 turns continuously, the turning force is delivered to the upper screw bar 62 since both of the upper and the lower screw bars 62 and 64 are integrated together. Such upper screw bar 62 is screw-connected to the screw-guidance ring 50 fixed at its position, thus, turns to any direction to move downward.

Briefly, the present inventive case is characterized in that the lower screw bar 64 firstly moves downward and applies pressure inside of the main body 10 to discharge the cosmetics 100 in case where the main body 10 turns to any desirable direction to provide the cosmetics 100; subsequently, the upper screw bar 62 falls down to discharge the remaining cosmetics 100. With respect of the present case, when the cosmetics 100 is completely drained out, both of the upper and the lower screw bars 62 and 64 fall down to make the piston 66 to contact bottom of the main body 10 as shown in FIG. 5.

As described above, the cosmetics ease of the present invention comprises both of upper and lower screw bars which move relatively each other as integrated by screw-connection between the upper and the lower screw bars to apply pressure cosmetics contained in a main body, and a piston moving by means of the above screw bars to accurately deliver the pressure and ensure discharging of the cosmetics, so that it can improve commercial value of goods and availability, eliminate noise and reduce production cost by simplification of parts for the case, thereby rendering production of the cosmetics case economically advantageous.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dischargeable case for liquid cosmetics including:

a main body to contain cosmetics and fitted with a piston; and an upper movable body coupled to a top portion of the main body and integrated with a nozzle member having a nozzle and a discharging member having exhausting holes, wherein an upper screw bar and a lower screw bar mounted on a top portion of the piston rotating to a desirable direction to press the piston downward and to render the cosmetics to be discharged though the nozzle and the exhaust holes, and a screw-guidance ring is screw-connected with the upper screw bar to help downward movement of the upper screw bar.

2. The cosmetics case as set forth in claim 1, wherein the nozzle member has the nozzle extending downward and a reversing-resistant ball inside, and is formed with a distribution groove having wider area on top portion of the nozzle member.

3. The cosmetics case as set forth in claim 1, wherein the upper screw bar and the lower screw bar are interconnected by screw-connection so that when turning the main body, the piston moves downward to render the cosmetics contained in the main body to be discharged through the nozzle and the exhausting holes.

4. The cosmetics case as set forth in claim 1, wherein the screw-guidance ring has projections around peripheral side thereof and is engaged with an uneven part in the upper movable body, so that the upper screw bar rotates and moves along the screw-guidance ring.

5. The cosmetics case as set forth in claim 1, wherein both of the upper and lower screw bars and are constructed to press the piston by moving the lower screw bar downward then moving the upper screw bar downward.

* * * * *